United States Patent [19]

Andersson, deceased et al.

[11] Patent Number: 4,641,464

[45] Date of Patent: Feb. 10, 1987

[54] DOWNPIPE

[75] Inventors: Karl G. Andersson, deceased, late of Risögrund, Sweden, by Marianne Berglund, heir; Bengt Paulsson, Järnforsen, Sweden

[73] Assignee: AB Siba-Verken, Jarnforsen, Sweden

[21] Appl. No.: 711,004

[22] Filed: Mar. 12, 1985

[30] Foreign Application Priority Data

Mar. 12, 1984 [SE] Sweden ..... 8401359
May 25, 1984 [SE] Sweden ..... 8402832

[51] Int. Cl.[4] ..... E04D 13/08

[52] U.S. Cl. ..... 52/16; 137/119; 137/615

[58] Field of Search ..... 52/16, 12, 11, 658; 405/119, 120, 121; 137/615, 120, 119; 403/403, 205; 138/120, 118, 155; 285/283

[56] References Cited

U.S. PATENT DOCUMENTS 1,430,197 9/1922 Sonday ..... 137/615
3,305,998 2/1958 Deisenroth ..... 52/658
4,116,008 9/1978 Ward ..... 52/11
4,117,635 10/1978 Nelson ..... 52/11
4,258,510 3/1981 Guiana ..... 52/16
4,270,572 6/1981 Jarzynka ..... 52/16
4,368,601 1/1983 Price ..... 52/16

*Primary Examiner*—John E. Murtagh
*Attorney, Agent, or Firm*—Browdy and Neimark

[57] ABSTRACT

The present invention relates to a downpipe (10) provided with a longitudinally extending slot (16). When joining two downpipe sections together, by means of a longitudinal join or an angled join, the longitudinal slot enables the upper downpipe section to be compressed slightly so that it can be readily pushed into the lower downpipe section. Pipe-bends intended, for example, to serve as water outlets, may readily be formed by cutting a notch or recess (22', 22'') through the flanges (14) defining the slot (16) and through the laterally located legs (18) of the downpipe, and then forming a fold at the bottom of the notch in the rear side (20) of the downpipe. Pipe-bends and water outlets can be fixed in position by joining together the overlapping sides with the aid of screws, rivets or like fasteners (26). The longitudinal slot of two adjacent sections can face in opposite directions.

12 Claims, 16 Drawing Figures

DOWNPIPE

BACKGROUND OF THE INVENTION

The present invention relates to a downpipe or the like.

Known downpipes commonly used comprise a fully closed pipe, normally of circular cross-section. The known downpipes, however, are encumbered with a number of disadvantages. Because the pipes are fully closed, ice plugs are liable to form therein when the pipes are repeatedly subjected to freezing and thawing weather conditions, resulting finally in fracture. Furthermore, such downpipes are complicated and unwieldy from the aspect of manufacture. All bends and curves in the pipe are produced by cutting the pipe ends obliquely and joining the oblique ends together, meaning in practice that all downpipe sections having pipe bends therein must be produced in the workshop to exact measurements. Correspondingly, when joining together long downpipes, it is necessary to connect the upper downpipe section to a part which tapers conically, which is also best produced in the workshop. The lower section of the downpipe on the other hand can be cut directly to the required length on the working site. This results in waste, however, in the form of residual short pieces of pipe.

The object of the present invention is to provide a downpipe which is not liable to freeze during the winter time, and which can be joined to curved and spliced downpipe sections directly on the working site.

With this object in view a downpipe according to the invention comprises one or more tubular sections each presenting an open longitudinally extending slot.

The presence of a longitudinally extending opening effectively prevents the downpipe from freezing to bursting point, since the downpipe is able to expand freely when freezing and to return to its original form when thawing. If an ice plug should form, thaw water is able to run out through the slot. Moreover is possible to reach such an ice plug through the slot and dislodge and remove the same.

A downpipe according to the invention, and above all a downpipe of non-round section, suitably has an inwardly directed fold located opposite the slot. When joining or bending downpipe sections, the downpipe section located innermost in the joint is further upset slightly in the region of the fold, so as to sharpen the fold and to reduce the dimensions of the downpipe laterally, wherewith it is readily adaptable to the other downpipe section.

When joining downpipe sections longitudinally, it is possible with a number of embodiments of the invention to make the joins so that the slots in the two sections either fall in the extensions of each other or in a position corresponding to said extension. The joint can also be made with the aid of a short connector piece of the same cross-section as the downpipe sections to be joined, the connector piece being rotated through 180° in relation to the long downpipe sections.

The downpipe can be terminated towards the elongated slot with either a straight cut edge, a double-folded edge and above all an inwardly bent edge which prevents water flowing in the downpipe from attempting to escape through the slot.

The presence of the slot in the downpipe presents no disadvantage and creates no problems, since the water normally follows the outer surface of the downpipe adjacent the slot and can be caught again in the next pipe-join or pipe-bend.

Should the amount of water leaving through the slot become unmanageable, a notch or recess can be cut in the pipe from the region of the slot and the pipe plate bent outwardly beneath the recess, so as to re-catch the water. The outwardly bent plate thus functions as a guide tongue which re-catches the water. The outer surface of the downpipe may be provided in the region of the slot or at a given distance therefrom with a coating of water repelling paint or like substance which ensures that any water on the outer surfaces of the downpipe is returned at the next join.

The invention will now be described in more detail with reference to embodiments of the invention illustrated in the accompanying drawings, in which FIG. 1 is a vertical side view of a downpipe according to the invention, incorporating a notch or recess intended for producing a pipe-bend;

Figure 1:
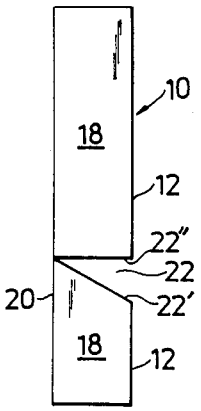

FIGS. 1–5 show various views of a downpipe according to the invention of rectangular section 10, comprising a front 12 which presents two flanges 14 and a longitudinally extending slot 16, two laterally located legs 18 and a rear side 20 located opposite the slot. The rear side 20 may be provided with an inwardly directed fold (not shown) and the legs 18 with corresponding, slightly outwardly directed folds (not shown). These folds facilitate the joining of longitudinal sections and angular connection of the downpipe according to the invention.

Figure 2:
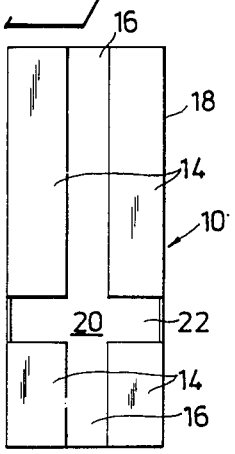
FIG. 2 is a vertical front view of the downpipe illustrated in FIG. 1.

FIGS. 1 and 2 illustrate the presence of a recess or notch 22 in the flanges 14 and the legs 18. The bend on the downpipe is created by forming a fold 24 in the rear side of the pipe at the apex of the recess 22. When bending the pipe thus, it is ensured that the lower legs 18 are located externally of the upper legs. This avoids leakages. The positions of the pipe-bends can be secured by placing screws, rivets or like fasteners 26 through the overlapping parts of the flanges 18. A spacer washer may also be placed between the legs 18, so as to enable water flowing on the outer surface of the pipe to be re-caught.

Figure 3:
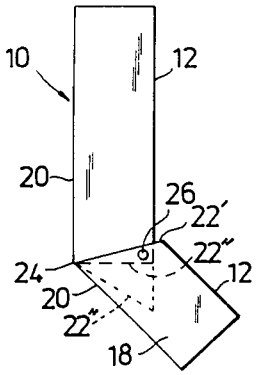
FIG. 3 is a side view of the downpipe shown in FIG. 1 subsequent to having bent the same to form the pipe-bend.
Figure 4:
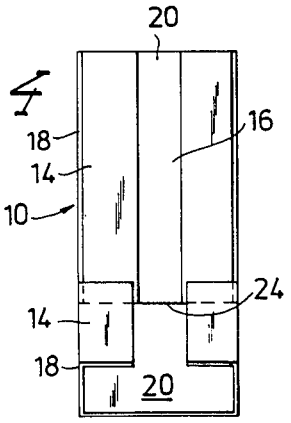
FIG. 4 is a vertical front view of the downpipe illustrated in FIG. 3.
Figure 5:
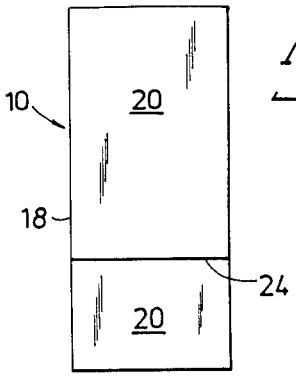
FIG. 5 is a vertical view of the rear side of the downpipe in FIG. 3.

The notch or recess 22 may optionally be replaced with an oblique saw cut in the region of the illustrated lower surface of section 22' in the flanges 18. This is indicated in FIG. 3 by the surface of section 22'' shown in broken lines. A recess or notch should also be made in this case in the flanges 14, so as not to choke the flow in the pipe-bend.

Figure 6:
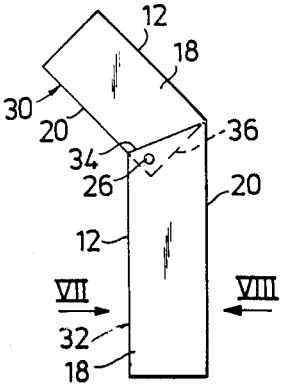
FIG. 6 is a side view of an angled pipe joint according to the invention.
Figure 7:
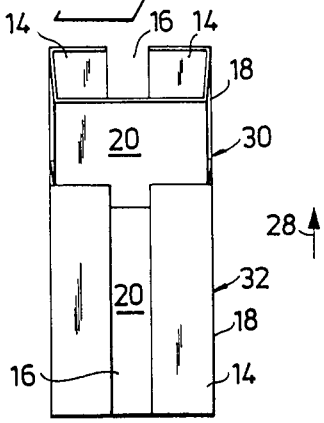
FIG. 7 is a vertical view of the pipe joint in FIG. 3, seen in the direction of the arrow VII.
Figure 8:
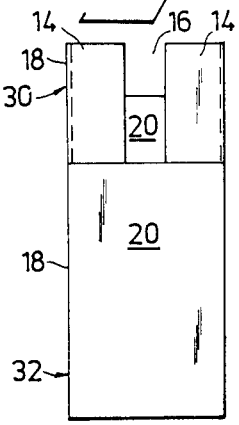
FIG. 8 is a vertical view of the pipe joint in FIG. 6, seen in the direction of the arrow VIII.

FIGS. 6, 7 and 8 are three different views of an angular connection between two downpipe sections. The arrow 28 shows the upward direction. In this embodiment, the upper downpipe section 30 is turned so that the open side 12 is directed upwardly, while the lower downpipe section 32 is turned so that the slotted forward side 12 and the upper end 34 of the section 32 lies against the rear side 20 of the upper downpipe section. The lower end 36 of the upper downpipe section 30 projects into the upper end 34 of the lower downpipe section, wherewith the flanges on the forward side 12 of said upper end abut the rear side 20 of the lower downpipe section. The rear side 20 of the lower downpipe section may optionally extend over the lower end 34 of the upper downpipe section, to prevent splashing. In the case of small flows of water it is not necessary for the forward side 12 of the upper downpipe section to lie against the rear side of the lower downpipe section, and the two downpipe sections can be held together in a manner similar to that previously described with respect to the pipe-bends, i.e. with the aid of screws, rivets or like fasteners 26 passing through respective legs.

Figure 9:
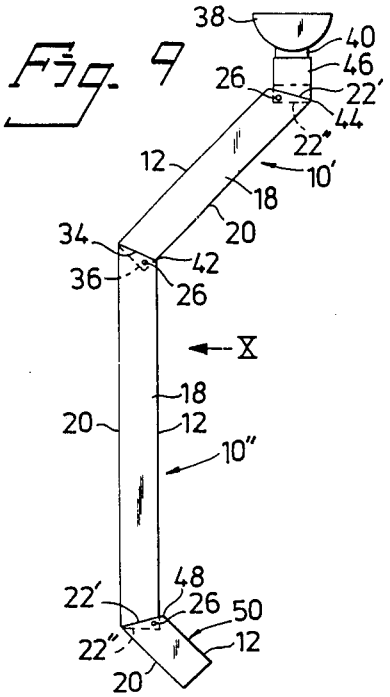
FIG. 9 is a vertical view of a downpipe according to the invention connected to roof guttering, seen in the longitudinal direction of the guttering.
Figure 10:
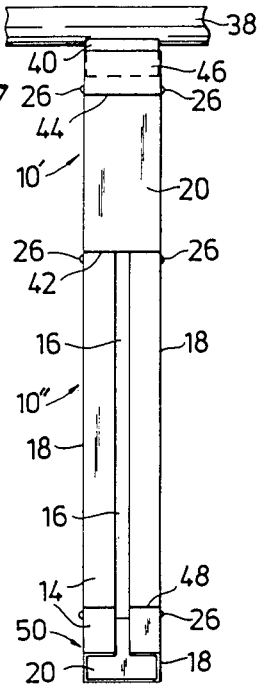
FIG. 10 is a vertical view of the downpipe illustrated ih FIG. 9, seen in the direction of the arrow X.
Figure 13:
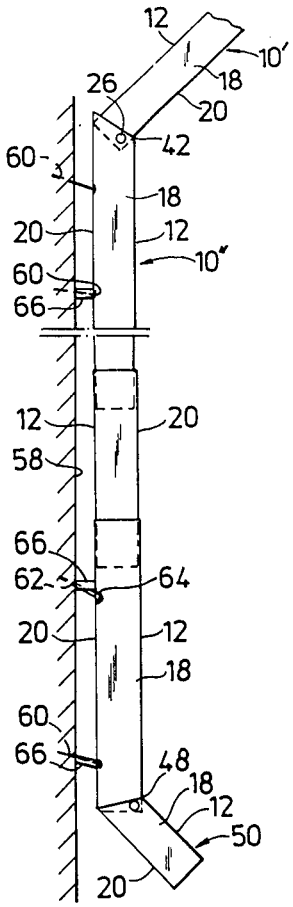
FIG. 13 illustrates a downpipe according to the invention secured to a wall.

FIGS. 9 and 10 are two different views of a downpipe according to the invention connected to a guttering 38 provided with an outlet connector 40. The downpipe comprises an upper section 10' and a lower section 10'' which are joined together by means of an angled pipe-joint 42. The upper downpipe section 10' is obliquely positioned, such that the downpipe extends adjacent the wall of the building, the upper pipe 10' having provided at the top thereof a pipe bend 44 at its vertical connecting end 46. The lower section 10'' is provided with a similar pipe-bend 48 having an outlet section 50 arranged therebeneath.

Figure 11:
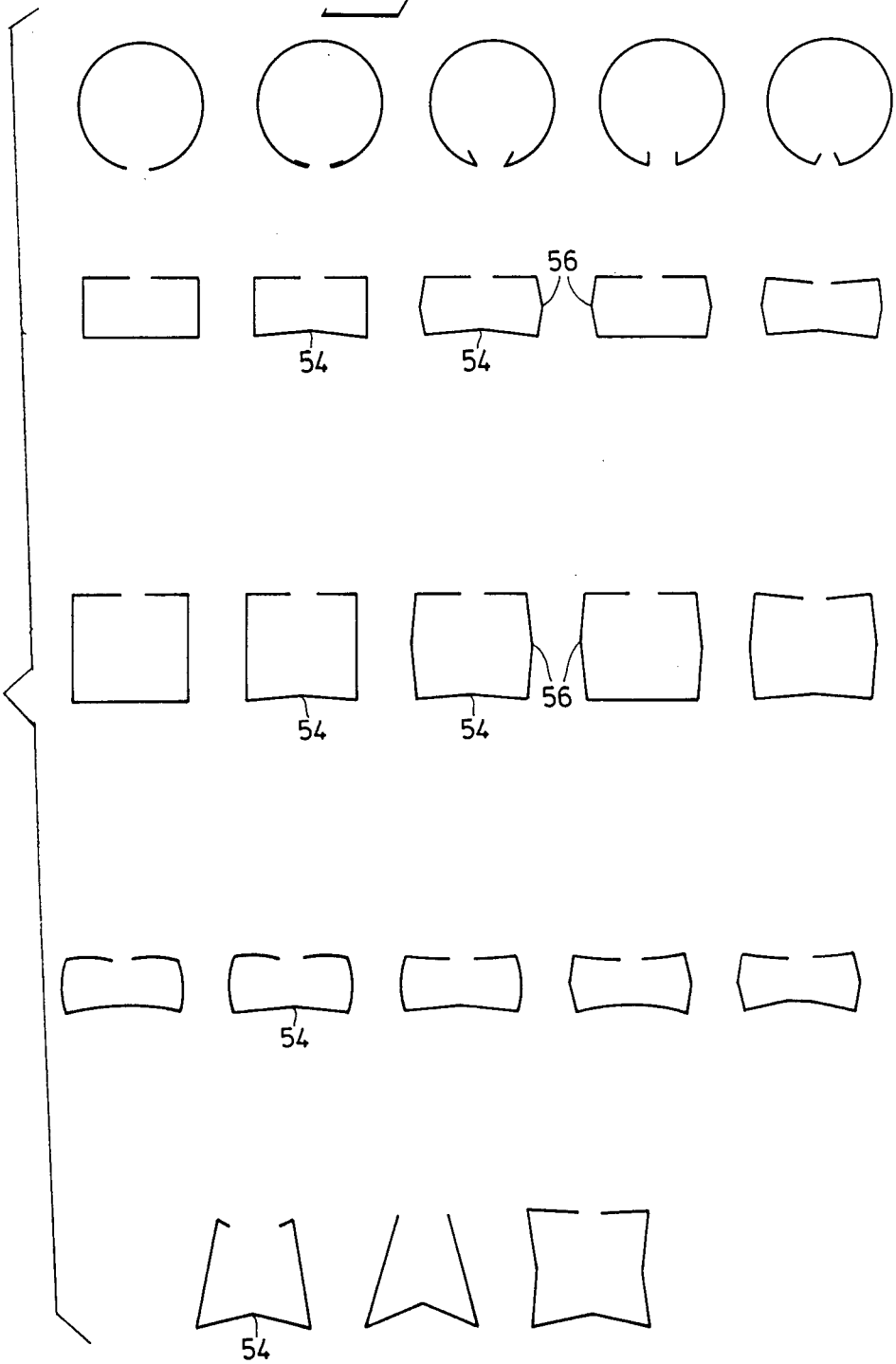
FIG. 11 illustrates various cross-section profiles of downpipes according to the invention.

FIG. 11 illustrates various cross-sectional profiles of a downpipe according to the invention. As previously mentioned, the most favourable sections are those which include an inwardly directed fold 54 on the side opposite the slot. In the case of rectangular sections, an advantage is also afforded when outwardly directed folds 56 are formed on the side flanges. This facilitates the joining of two downpipe sections, since these folds can be straightened out or made larger, so as to extend or shorten the side flanges when joining said downpipe sections.

Figure 12:
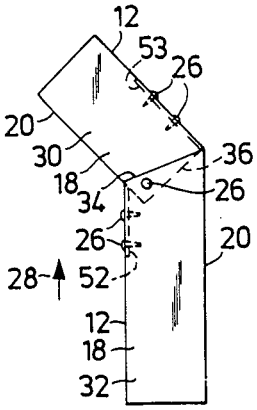
FIG. 12 illustrates an angled pipe joint provided with strengthening tongues.

FIG. 12 illustrates a modified pipe-bend connection, in which the rear sides 20 of respective downpipe sections present an outwardly projecting angled extension or tongue 52,53, bent to lie against the forward side 12 of the other downpipe section. The extensions or tongues can be secured to respective forward sides with the aid of rivets or like fasteners, this provides a pipe-bend which is highly resistant to torsional forces, particularly when both the downpipe sections are provided with such tongues.

The ability of the angled pipe joints to retain their shape and form is achieved through the holding screws or rivets, and by the fact that end surfaces of one downpipe section abut the other or inner side of the other downpipe section.

The downpipe according to the present invention affords a unique possibility of readily mounting the downpipe on a wall 58 or like structure. Instead of securing the downpipe with the aid of special brackets which embrace the pipe, it is possible to utilize the slot in the downpipe and simply nail or screw the downpipe through the rear wall thereof. In this case, however, it should be ensured that an efficient seal is provided in the screw or nail hole and/or that the screw 62 or nail 60 are directed obliquely upwards. Spacer blocks 66 or like devices are advantageously arranged between the downpipe 10 and the adjacent wall 58 or like structure to which the downpipe is secured. A seal 64 can be provided in the region of the nails 60 or screws 62.

Figures 14, 15:
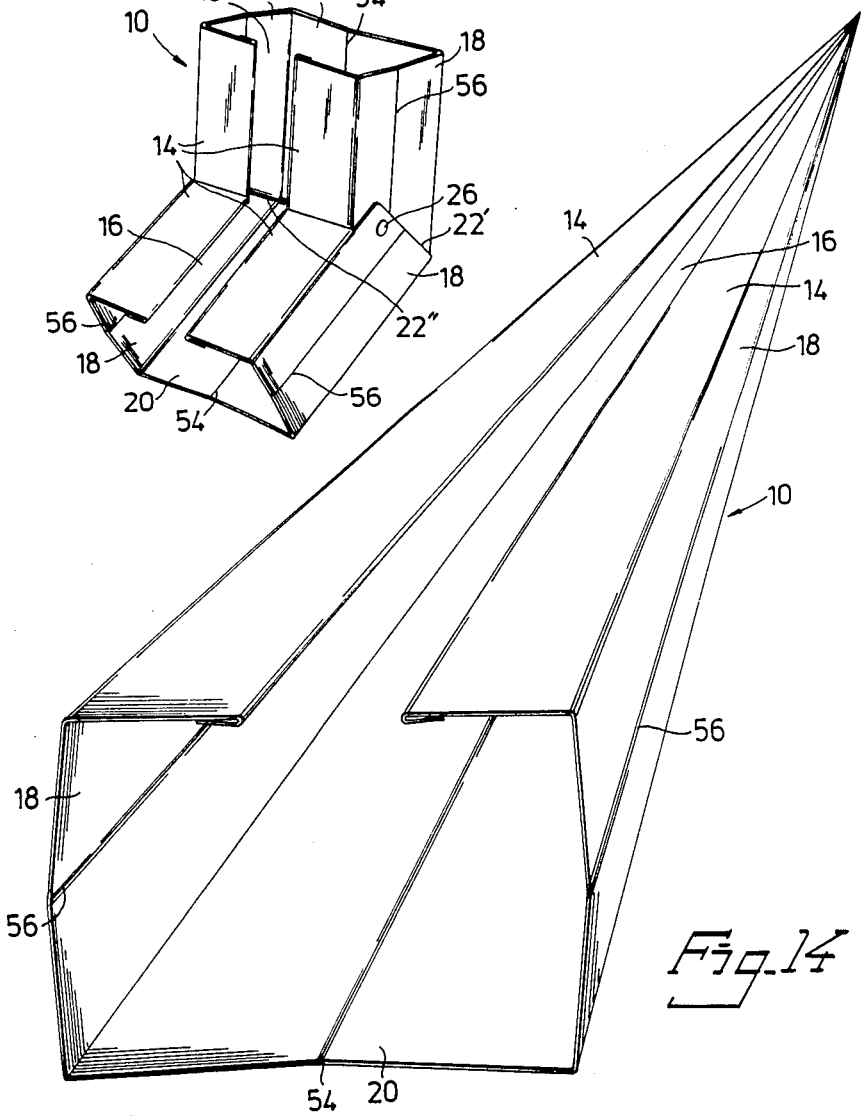
FIG. 14 is a view of an elongate section of pipes.
FIG. 15 is a view of a pipe bend.
Figure 16:
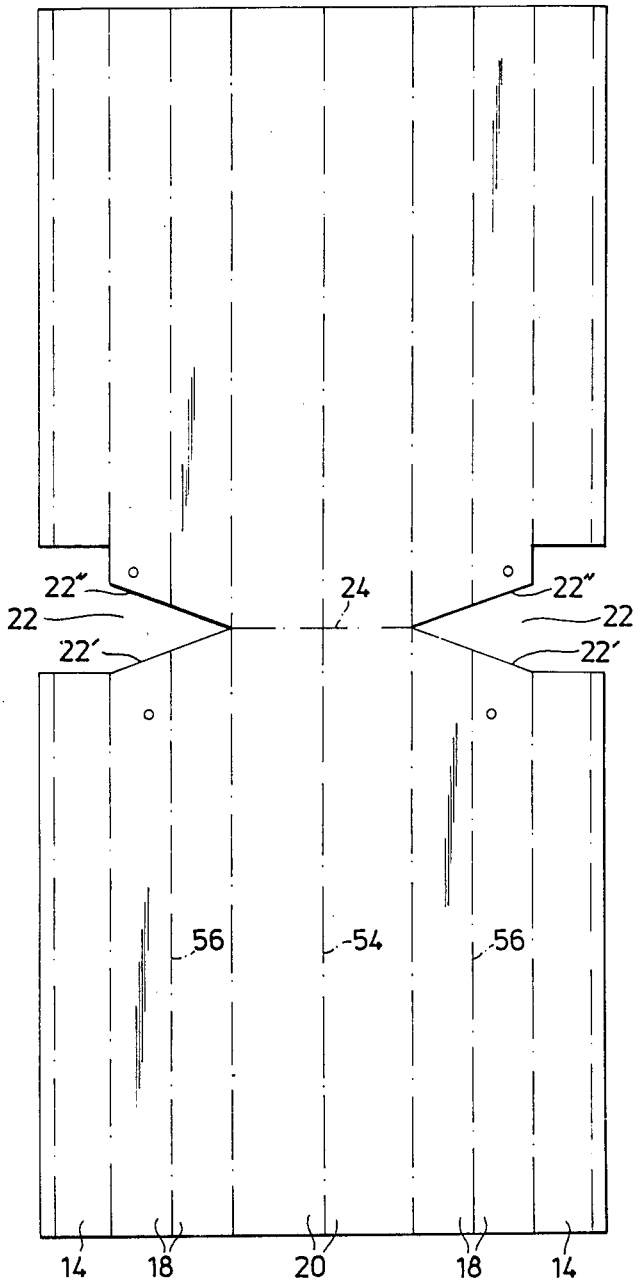
FIG. 16 shows a pipe bend prior to folding.

As can be understood from the foregoing, the downpipe according to the invention is or can be material saving. Furthermore, storing of such pipes is made much easier, as any number of pipe sections can be piled up and fills a certain given space more or less completely. Furthermore, such downpipe sections can be delivered with a paint or any other finnish, which does not have to be redone in the area of a join or bent, as no welding, bending or the like will be necessary, which would destroy an applied finnish. It has already been said, that the flanges and the laterally located legs may be bended somewhat towards each other for facilitating insertion of an upper pipe section into a lower one. It should be added, that the angle of the rear side fold easily may be reduced by locating said fold against for instance an edge of any element close by and then applying some pushing force to said flanges and said legs towards said rear side in the area of a join end of an upper pipe section. In this way, this end will be somewhat narrower even in the area of said rear side, so that this end easily fits into an upper joining end of a lower pipe section. Apart from these advantages, the design of a downpipe according to the invention serves to direct flowing water from the center to the sides and amazingly it has been found that under normal conditions, no water will flow out of the longitudinal slot but will be guided as safely as by a circumferentially closed pipe. The longitudinal slot does, of course, allow an easy inspection and prevents normally leaves, twigs, ice plugs etc from getting stuck or even arise in a downpipe according to the invention. The new downpipe also dries up much faster than a conventional downpipe, so that possible corrosion problems are minimized or eliminated. An advantage of the downpipe design as shown in FIG. 14 or similar resides also in the fact, that all folds, i.e. 54, 56 and the folds between the items 18 and 20 as well as between the items 14 and 18, may serve as center lines for bending and/or straightening forces, so that the downpipe design and dimensions easily may be altered manually and/or by means of simple tools or aids like edges of objects as hereinbefore described.

The invention is not restricted to the described and illustrated embodiments, and modifications can be made within the scope of the invention defined in the following claims.

We claim:

1. A downpipe, connectable to guttering on the outsides of building structures, comprising:

at least an upper tubular section and a lower tubular section, each section having a front side including an open longitudinally extending slot and a solid rear side disposed opposite said front side; and a longitudinal joint between said upper and lower sections produced by slightly compressing the upper section and inserting it in the lower section, the front side of said upper section being disposed adjacent the rear side of the lower section at said joint.

2. A downpipe according to claim 1, characterized in that the downpipe presents an inwardly directed, longitudinally extending fold on a side thereof opposite the slot.

3. A downpipe according to claim 1, characterized in that edges of the slot define inwardly directed, angled flange parts or double folds.

4. A downpipe according to claim 1, having a substantially rectangular cross-section, wherein the downpipe comprises a pipe-bend formed in said upper section by a notch extending through flanges defining the slot and through laterally located legs up to a side opposite the slot, and a fold at said rear side so that legs on the lower section are located outside corresponding legs on the upper section.

5. A downpipe according to claim 1, in which two down-pipe sections are joined together by means of screws, rivets or like fasteners, placed in laterally located legs of said section.

6. A downpipe according to claim 1, wherein the downpipe is secured to a wall of a building or like structure with screws, nails or like fasteners, passing through a rear wall of the downpipe opposite the slot.

7. A downpipe according to claim 6, and further including spacer means and the screws, nails or like fasteners being directed obliquely upwards through openings made by said fasteners through the wall of the downpipe.

8. A downpipe according to claim 1, wherein two of said downpipe sections are joined together by means of screws, rivets or like fasteners placed in tongues carried by, and projecting outwardly from at least one of, said downpipe sections.

9. A downpipe according to claim 6, and further including spacer means, the screws, nails or like fasteners being directed obliquely upwards and provided with seals in through openings made by said fasteners extending through the wall of the downpipe.

10. A downpipe connectable to, and extending downwardly from, guttering on the outsides of building structures, comprising:

a first tubular section and a second tubular section, each of said first and second tubular sections including a front side having an open longitudinally-extending slot and a solid rear side disposed opposite said front side, and a joint between said first and second tubular sections, the front side of said first section being contiguous with the rear side of said second section at said joint.

11. The downpipe of claim 10, wherein said joint comprises an end of said first section interfitted within an adjacent end of said second section.

12. A substantially vertically extending downpipe connectable to guttering on the outsides of building structures, comprising:

a channel member comprising a front side having an open longitudinally-extending slot, a solid rear side disposed opposite said front side, and side legs interconnecting said front and rear sides, notched means, disposed at a location along the length of said channel member, for dividing said channel member into said first and second tubular portions, and the side legs of one of said first and second tubular portions adjacent said dividing means being compressed and inserted into the space defined between the side legs of the other of said first and second tubular portions, whereby within the longitudinal extent of the downpipe one of said sections is disposed at an angle to the other of said sections.

* * * * *